US011690486B2

(12) United States Patent
Dashields, Sr.

(10) Patent No.: US 11,690,486 B2
(45) Date of Patent: Jul. 4, 2023

(54) TOILET SEAT MANIPULATION SYSTEM

(71) Applicant: George P. Dashields, Sr., Tobyhanna, PA (US)

(72) Inventor: George P. Dashields, Sr., Tobyhanna, PA (US)

( * ) Notice: Subject to any disclaimer, the term of this patent is extended or adjusted under 35 U.S.C. 154(b) by 0 days.

(21) Appl. No.: 17/516,077

(22) Filed: Nov. 1, 2021

(65) Prior Publication Data

US 2023/0138781 A1 May 4, 2023

(51) Int. Cl.
*A47K 13/10* (2006.01)

(52) U.S. Cl.
CPC ..... *A47K 13/105* (2013.01)

(58) Field of Classification Search
CPC ... A47K 13/105; A47K 13/245; B25J 15/0616
USPC ..... 248/537
See application file for complete search history.

(56) References Cited

U.S. PATENT DOCUMENTS 2,131,687 A * 9/1938 Kaplan ..... B66C 1/0275 D8/71
2,280,658 A 4/1942 Miller
2,318,518 A * 5/1943 Opperer ..... A47K 13/105 4/246.1
4,707,870 A * 11/1987 Glassco et al. ..... A47K 13/245 4/237
6,248,008 B1 6/2001 Williams
6,842,916 B1 * 1/2005 Gunn et al. ..... A47K 13/105 4/246.1
6,896,228 B1 * 5/2005 Lu ..... A47K 10/10 248/205.8
7,014,233 B2 3/2006 Chen
7,887,109 B2 2/2011 Liao
D635,350 S 4/2011 Leung et al.
2012/0090082 A1 4/2012 Nwankwo
2014/0005641 A1 1/2014 Slade et al.
2014/0051486 A1 2/2014 Ramirez et al.
2014/0082831 A1 * 3/2014 Yang ..... A47K 13/10 4/246.1

* cited by examiner

*Primary Examiner* — Erin Deery

(57) ABSTRACT

A toilet seat manipulation system includes a toilet that has a lid and a seat. Each of the lid and the seat is hingedly coupled to the toilet. A gripping unit is selectively coupled to the seat. The gripping unit is gripped thereby inhibiting the seat from being touched. The gripping unit removably engages the lid when the each of the lid and the seat is positioned in an open position. Thus, the seat is selectively retained in the open position.

5 Claims, 4 Drawing Sheets

TOILET SEAT MANIPULATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

Field of the Invention

Description of Related Art Including Information Disclosed Under 37 CFR 1.97 and 1.98

The disclosure and prior art relates to manipulation devices and more particularly pertains to a new manipulation device for facilitating a toilet to be opened without touching the toilet.

BRIEF SUMMARY OF THE INVENTION

An embodiment of the disclosure meets the needs presented above by generally comprising a toilet that has a lid and a seat. Each of the lid and the seat is hingedly coupled to the toilet. A gripping unit is selectively coupled to the seat. The gripping unit is gripped thereby inhibiting the seat from being touched. The gripping unit removably engages the lid when the each of the lid and the seat is positioned in an open position. Thus, the seat is selectively retained in the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
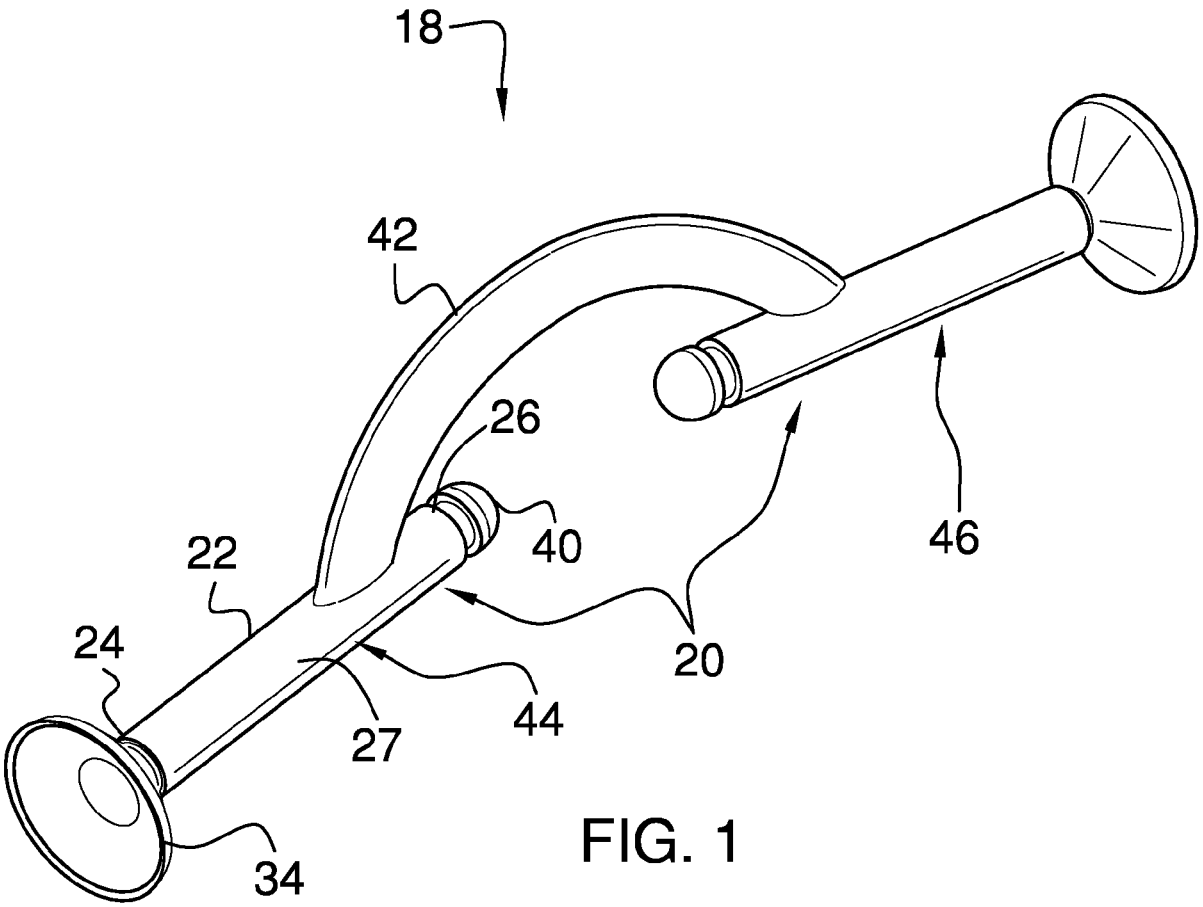
FIG. 1 is a perspective view of a toilet seat manipulation system according to an embodiment of the disclosure.
Figure 2:
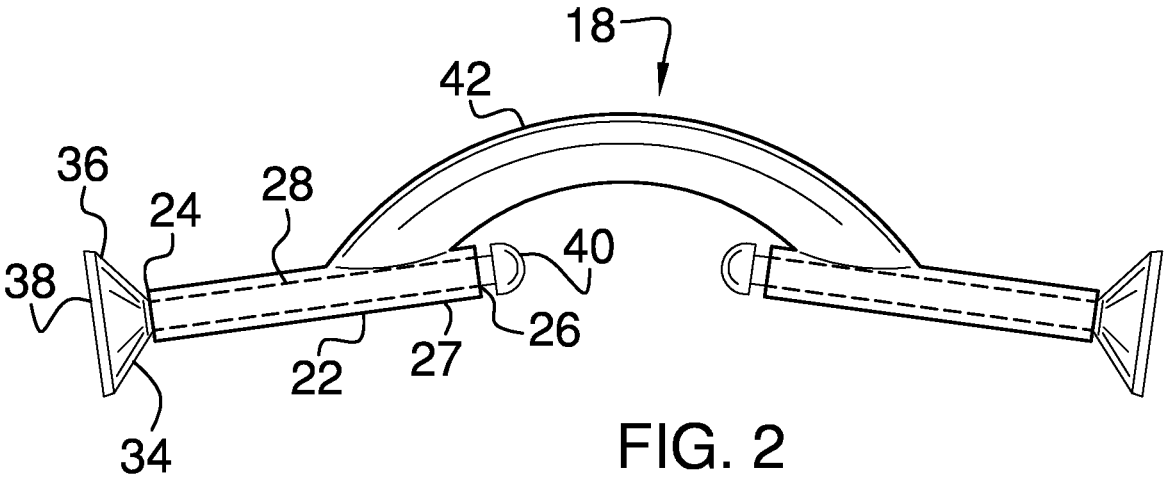
FIG. 2 is a front view of an embodiment of the disclosure.
Figure 3:
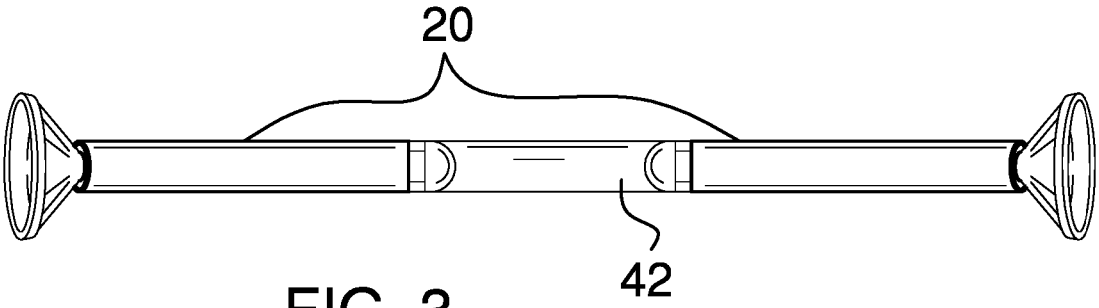
FIG. 3 is a bottom view of an embodiment of the disclosure.
Figure 4:
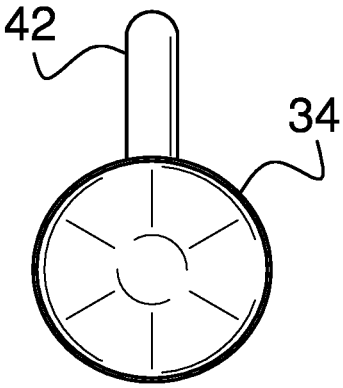
FIG. 4 is a right side view of an embodiment of the disclosure.
Figure 5:
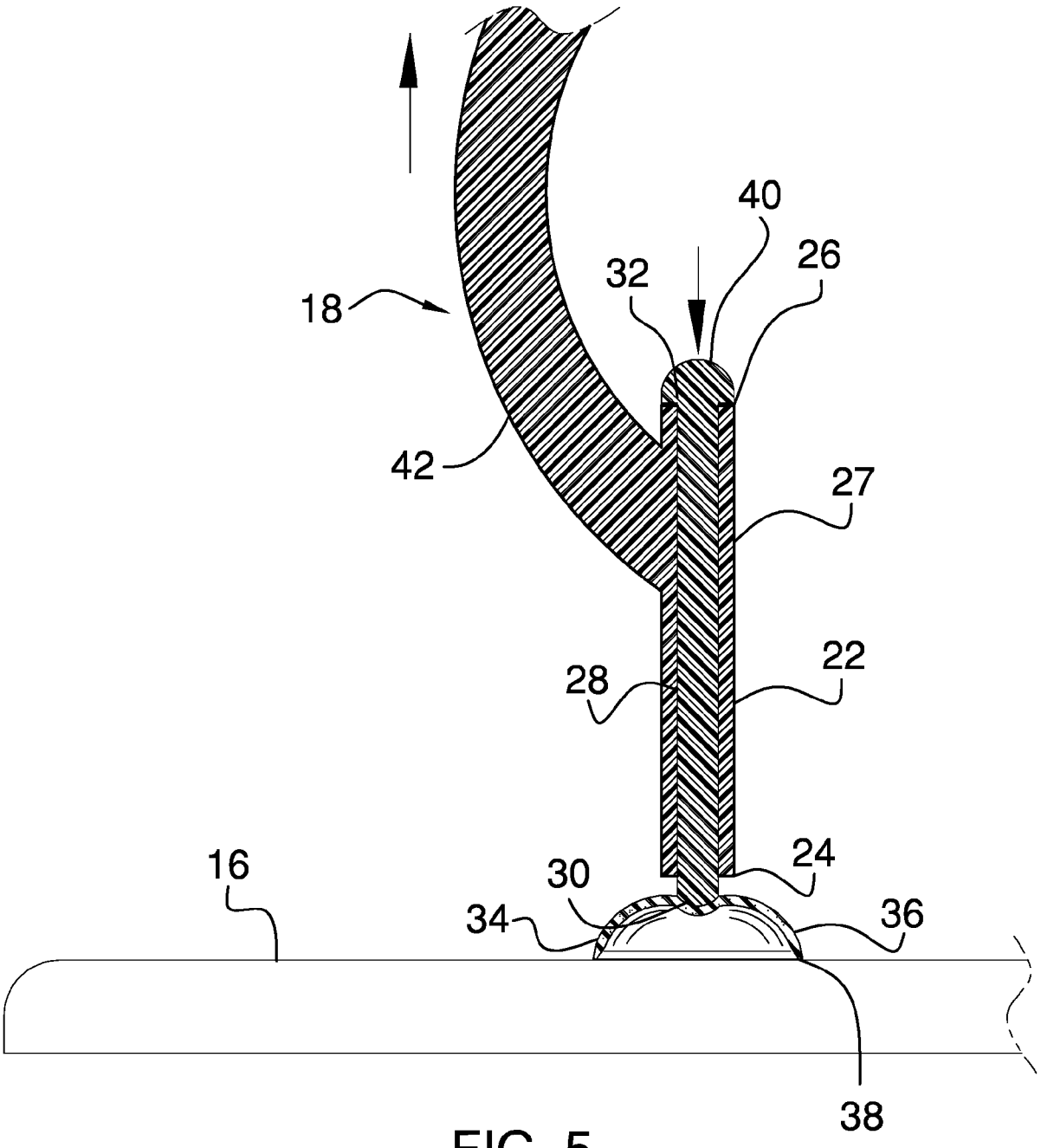
FIG. 5 is a perspective cut-away view of an embodiment of the disclosure.
Figure 6:
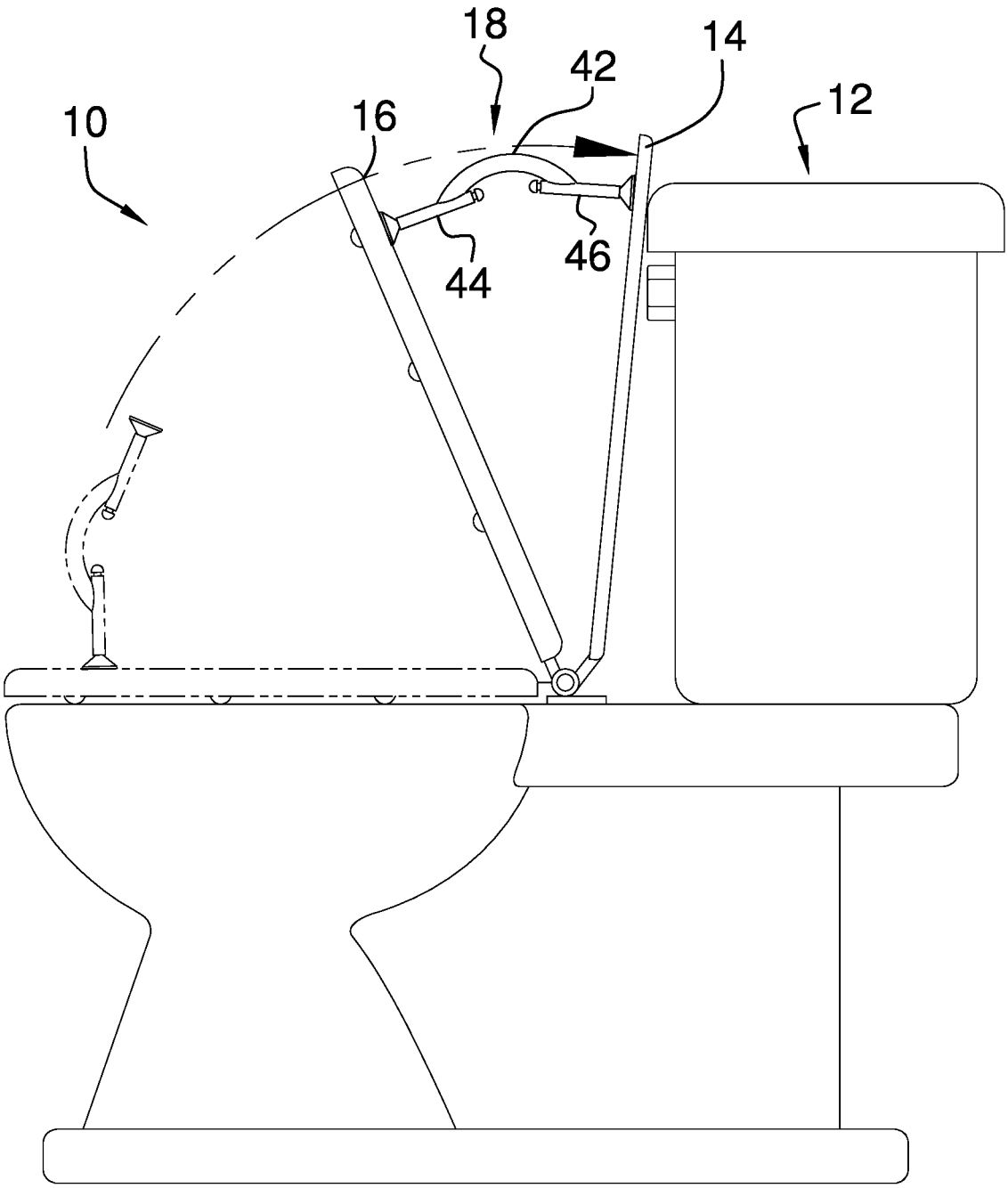
FIG. 6 is a perspective in-use view of an embodiment of the disclosure.

With reference now to the drawings, and in particular to FIGS. 1 through 6 thereof, a new manipulation device embodying the principles and concepts of an embodiment of the disclosure and generally designated by the reference numeral 10 will be described.

As best illustrated in FIGS. 1 through 6, the toilet seat manipulation system 10 generally comprises a toilet 12. The toilet 12 has a lid 14 and a seat 16. Each of the lid 14 and the seat 16 is hingedly coupled to the toilet 12. The toilet 12 may be a toilet 12 of any conventional design.

A gripping unit 18 is provided. The gripping unit 18 is selectively coupled to the seat 16. The gripping unit 18 may be gripped thereby inhibiting the seat 16 from being touched. Thus, the gripping unit 18 inhibits a user from contacting bacteria on the seat 16. The gripping unit 18 removably engages the lid 14 when the each of the lid 14 and the seat 16 is positioned in an open position. Thus, the seat 16 is selectively retained in the open position.

The gripping unit 18 comprises a pair of fasteners 20. Each of the fasteners 20 selectively engages the lid 14 and the seat 16. Each of the fasteners 20 comprises a tube 22 that has a first end 24, a second end 26 and an outer wall 27 extending therebetween. Each of the first end 24 and the second end 26 is open.

A shaft 28 is provided. The shaft 28 has a primary end 30 and a secondary end 32. The shaft 28 is slidably positioned within the tube 22. The shaft 28 extends outwardly from each of the first end 24 and the second end 26.

A suction cup 34 is provided that has a first wall 36. The first wall 36 is coupled to the primary end 30 of the shaft 28. The first wall 36 has a distal edge 38 with respect to the shaft 28. The first wall 36 is convexly arcuate between the shaft 28 and the distal edge 38. The suction cup 34 is selectively compressed against the toilet 12. Thus, the suction cup 34 suctionally engages the toilet 12.

A button 40 is provided. The button 40 is coupled to the secondary end 32 of the shaft 28 and the button 40 may be manipulated. The button 40 urges the first wall 36 toward the toilet 12 when the button 40 is manipulated. Thus, the suction cup 34 may be removed from the toilet 12.

A handle 42 is provided. The handle 42 is coupled between the outer wall 27 of each of the fasteners 20 and the handle 42 may be gripped. The handle 42 is concavely arcuate between the fasteners 20. Thus, the handle 42 enhances manipulating the seat 16 and the lid 14. The button 40 corresponding to each of the fasteners 20 is directed toward each other. Moreover, each of the fasteners 20 angles downwardly from a center of the handle 42.

The pair of fasteners 20 includes a first fastener 44 and a second fastener 46. The suction cup 34 corresponding to the first fastener 44 suctionally engages the seat 16. The suction cup 34 corresponding to the second fastener 46 suctionally engages the lid 14 when the seat 16 is urged toward the lid 14. Thus, the seat 16 is retained in the open position.

In use, the handle 42 is manipulated to position the suction cup 34 corresponding to the first fastener 44 to engage the seat 16. Thus, the gripping unit 18 is removably coupled to the seat 16. The handle 42 is manipulated to urge the seat 16 into the open position. The seat 16 hinges toward the lid 14 unit the suction cup 34 corresponding to the second fastener 46 engages the lid 14. Thus, the seat 16 is retained in the open position. The seat 16 is positioned in the open position to facilitate a male to urinate in the toilet 12. The seat 16 is positioned in the open position to inhibit the male from urinating on the seat 16. The button 40 corresponding to each of the first 44 and second 46 fasteners is manipulated to remove the gripping unit 18 from the toilet 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat manipulation system comprising:

a toilet having a lid and a seat, each of said lid and said seat being hingedly coupled to said toilet; and a gripping unit being selectively coupled to said seat wherein said gripping unit is configured to be gripped thereby inhibiting said seat from being touched, said gripping unit removably engaging said lid when said each of said lid and said seat is positioned in an open position such that said seat is selectively retained in said open position, wherein said gripping unit comprises a pair of fasteners, each of said fasteners selectively engaging said lid and said seat, respectively, each of said fasteners comprising:

a tube having a first end, a second end and an outer wall extending therebetween, each of said first end and said second end being open, a shaft having a primary end and a secondary end, said shaft being slidably positioned within said tube and having said shaft extending outwardly from each of said first end and said second end, a suction cup having a first wall, said first wall being coupled to said primary end of said shaft, said first wall having an distal edge with respect to said shaft, said first wall being convexly arcuate between said shaft and said distal edge, said suction cup being selectively compressed against said toilet such that said suction cup suctionally engages said toilet.

2. The system according to claim 1, further comprising a button being coupled to said secondary end of each shaft wherein said button is configured to be manipulated, said button urging said first wall of each suction cup toward said toilet when said button is manipulated thereby facilitating said suction cup to be removed from said toilet.

3. The system according to claim 1, further comprising a handle being coupled between said outer wall of each of said fasteners wherein said handle is configured to be gripped, said handle being concavely arcuate between said fasteners wherein said handle is configured to enhance manipulating said seat and said lid.

4. The system according to claim 1, wherein said pair of fasteners includes a first fastener and a second fastener, each suction cup extending from a respective corresponding one of said first fastener and said second fastener, said suction cup corresponding to said first fastener suctionally engaging said seat, said suction cup corresponding to said second fastener suctionally engaging said lid when said seat is urged toward said lid.

5. A toilet seat manipulation system comprising:

a toilet having a lid and a seat, each of said lid and said seat being hingedly coupled to said toilet; and a gripping unit being selectively coupled to said seat wherein said gripping unit is configured to be gripped thereby inhibiting said seat from being touched, said gripping unit removably engaging said lid when said each of said lid and said seat is positioned in an open position such that said seat is selectively retained in said open position, said gripping unit comprising:

a pair of fasteners, each of said fasteners selectively engaging said lid and said seat, respectively, each of said fasteners comprising:

a tube having a first end, a second end and an outer wall extending therebetween, each of said first end and said second end being open, a shaft having a primary end and a secondary end, said shaft being slidably positioned within said tube and having said shaft extending outwardly from each of said first end and said second end, a suction cup having a first wall, said first wall being coupled to said primary end of said shaft, said first wall having an distal edge with respect to said shaft, said first wall being convexly arcuate between said shaft and said distal edge, said suction cup being selectively compressed against said toilet such that said suction cup suctionally engages said toilet, and a button being coupled to said secondary end of said shaft wherein said button is configured to be manipulated, said button urging said first wall toward said toilet when said button is manipulated thereby facilitating said suction cup to be removed from said toilet;

a handle being coupled between said outer wall of each of said fasteners wherein said handle is configured to be gripped, said handle being concavely arcuate between said fasteners wherein said handle is configured to enhance manipulating said seat and said lid; and said pair of fasteners including a first fastener and a second fastener, each suction cup extending from a respective corresponding one of said first fastener and said second fastener, said suction cup corresponding to said first fastener suctionally engaging said seat, said suction cup corresponding to said second fastener suctionally engaging said lid when said seat is urged toward said lid.

* * * * *